US005253552A

United States Patent [19]

Brand et al.

[11] Patent Number: 5,253,552

[45] Date of Patent: Oct. 19, 1993

[54] TONG-LIKE DEVICE FOR OPENING SCREW-ON LIDS

[75] Inventors: Dieter Brand, Bad Ems; Peter Kern, Stuttgart; Johannes G. Solf, Sindelfingen, all of Fed. Rep. of Germany

[73] Assignee: Leifheit AG, Nassau/Lahn, Fed. Rep. of Germany

[21] Appl. No.: 772,844

[22] Filed: Oct. 8, 1991

[30] Foreign Application Priority Data

Oct. 8, 1990 [EP] European Pat. Off. ..... 90119292/2

[51] Int. Cl.[5] ..... B67B 7/18

[52] U.S. Cl. ..... 81/3.42

[58] Field of Search ..... 81/3.4, 3.42, 3.44, 81/487; 269/6, 166, 169

[56] References Cited

U.S. PATENT DOCUMENTS

| | | | |
|---|---|---|---|
| 2,796,782 | 6/1957 | Rosenthal | 81/3.42 |
| 3,096,975 | 7/1963 | Irwin | 269/169 |
| 3,724,296 | 4/1973 | Graver | 81/3.42 |
| 3,822,614 | 7/1974 | Kovacevic . | |
| 4,926,722 | 5/1990 | Sorensen et al. | 81/487 |
| 5,005,449 | 4/1991 | Sorensen et al. | 81/487 |
| 5,009,134 | 4/1991 | Sorensen et al. | 81/487 |

*Primary Examiner*—Roscoe V. Parker
*Attorney, Agent, or Firm*—Frishauf, Holtz, Goodman & Woodward

[57] ABSTRACT

A tong-like device for opening jar lids of various sizes, having a retaining handle and an actuating handle that is swivelable on it about a bearing, a drawbar longitudinally adjustable with the retaining handle and having a clamping bracket, and retaining claws provided on the end of the retaining handle; a draw plate (24) is displaceable on the flat drawbar (11) having the clamping bracket (13) and is pressed via a compression spring against a guide wall (22) that is at right angles to the drawbar (11), in such a manner that an impingement region (26) of the draw plate rests against a pressure rib (27) of the actuating handle (1) that is swivelable about a bearing (2).

17 Claims, 3 Drawing Sheets

TONG-LIKE DEVICE FOR OPENING SCREW-ON LIDS

BACKGROUND OF THE INVENTION

1. Field of the Invention

This invention relates generally to tong-like devices for opening screw-on caps and screw-on lids of containers and bottles and more particularly screw-on lids and caps for jars.

2. Description of the Prior Art

Devices of this kind, including devices known as jar lid openers, are used in virtually every household. One very well-known device of this type which has two handles is described in German Utility Model 76 14 833 wherein the two handles are ergonomically close enough together only when the device is used to open a small bottle cap. The situation is drastically worse for large screw-on lids, as on jam jars. A user with small hands is virtually incapable of opening a jar with the device disclosed in German Utility Model 76 14 833 without assistance by another person.

This deficiency has been eliminated by a jar lid opener of the type described in U.S. Pat. No. 3,822,614. This U.S. patent discloses that a longitudinally displaceable rack with a clamping bracket is first adjusted generally to fit the size of the jar lid and is then tightened by actuation of the actuating handle to more closely fit the lid. However, the use of a rack necessitates relatively long travel on the part of the actuating handle, because of the spacing of the teeth which is a significant inconvenience to the user. Moreover, the idle play of the handle that occurs at the beginning of the motion is long, even when the toothing is fine. Moreover, in U.S. Pat. No. 3,822,614, the toothing is expensive to make. Additionally, if the teeth are very fine, it is difficult to transmit the major forces that arise by the effort of the user. Overall, for a simple household device, the mechanics of U.S. Pat. No. 3,822,614 are very complicated.

SUMMARY OF THE INVENTION

The object of this invention is to provide a container opener, particularly a bottle and jar lid opener which can be used for both large and small screwed-on lids with the same handle position and the same expenditure of force.

Another object of the invention is to provide a container opener which can be used for both large and small screwed-on lids with the same handle position and the same expenditure of force which is embodied in a ergonomically efficient device which can be used by both left-handed users and right-handed users.

A further object of the present invention is to provide a container opener which is simple to use and provides a strong clamping force on the container lid which prevents slippage and thereby facilitates opening of the jar lid.

Still another object of the present invention is to provide a device which can unscrew lids by simply squeezing two handles of the device toward each other.

BRIEF DESCRIPTION OF THE INVENTION

This invention discloses a tong-like container lid opener having a flat drawbar which enables infinitely fine adjustment to any size of jar lid, and thus provides a short adjustment path for the actuating handle. This arrangement in turn insures that an ergonomically optimal hand position can always be employed. Because of the short adjustment path, it also does not matter when using the container lid opener of the present invention whether the device is used with the left or the right hand.

Moreover, the invention guides a slide handle in a guide slit of a retaining handle to enable particularly simple adjustment of the drawbar and clamping bracket. A spacer protrusion prevents bowing or destruction of parts of the tong-like lid opening device when the device is actuated with the drawbar pushed all the way in (i.e. a small lid position).

A U-shaped actuating handle can be used to make the tong-like lid opener particularly convenient to manipulate.

Furthermore, an angularly corrected position of clamping claws relative to retaining claws enables secure clamping onto both small and large screw on jar lids. A polygonal shaped drawbar can be used to resist torsional forces.

DETAILED DESCRIPTION OF THE EMBODIMENTS

Figure 1:
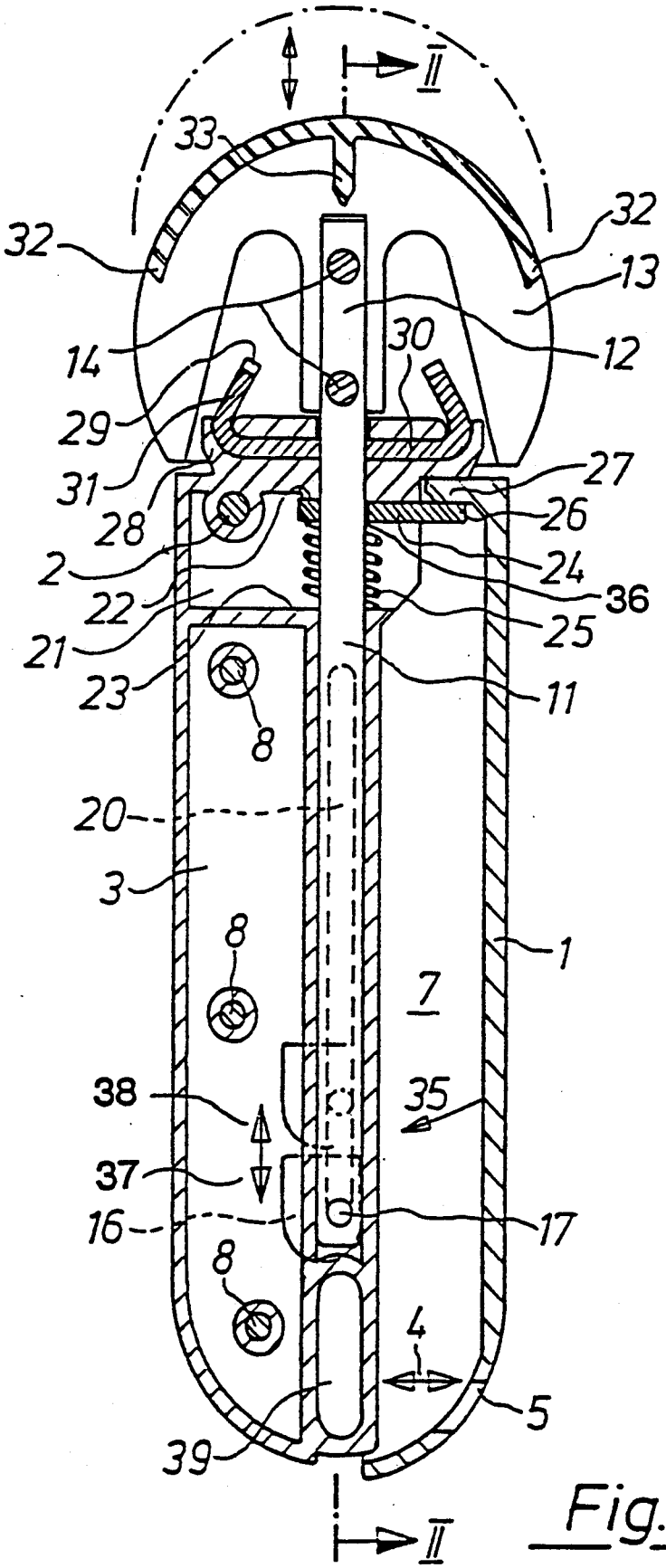
FIG. 1 shows a view of the device in a neutral position in which both the retaining handle and the actuating handle are shown partially in section.

Referring to FIG. 1, an actuating handle 1 is swivelable about a bearing 2 in the retaining handle 3. The adjustment path (shown by arrows 4) of the actuating handle 1 is limited by a stop 5 in the actuating handle 1. The actuating handle 1 has a U-shaped construction and upon adjustment of the actuating handle, fits over and engages the retaining handle 3.

Figure 2:
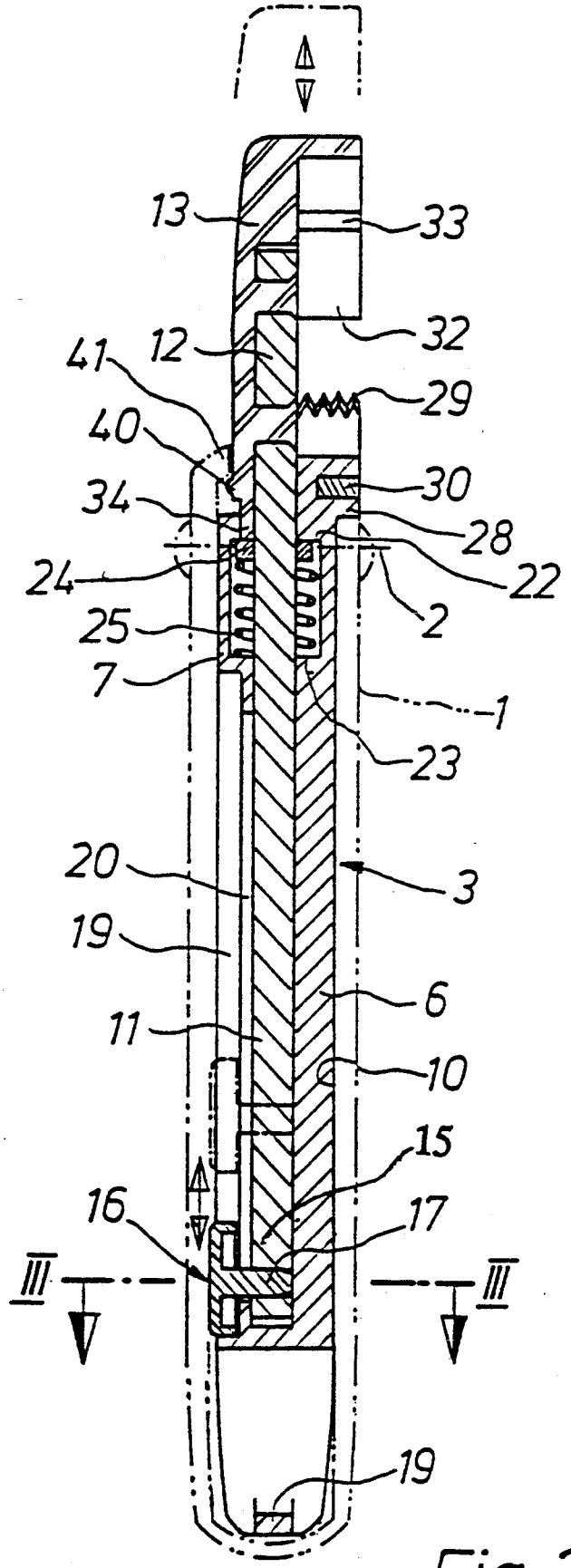
FIG. 2 is a sectional view taken along the line II—II of FIG. 1.
Figure 3:
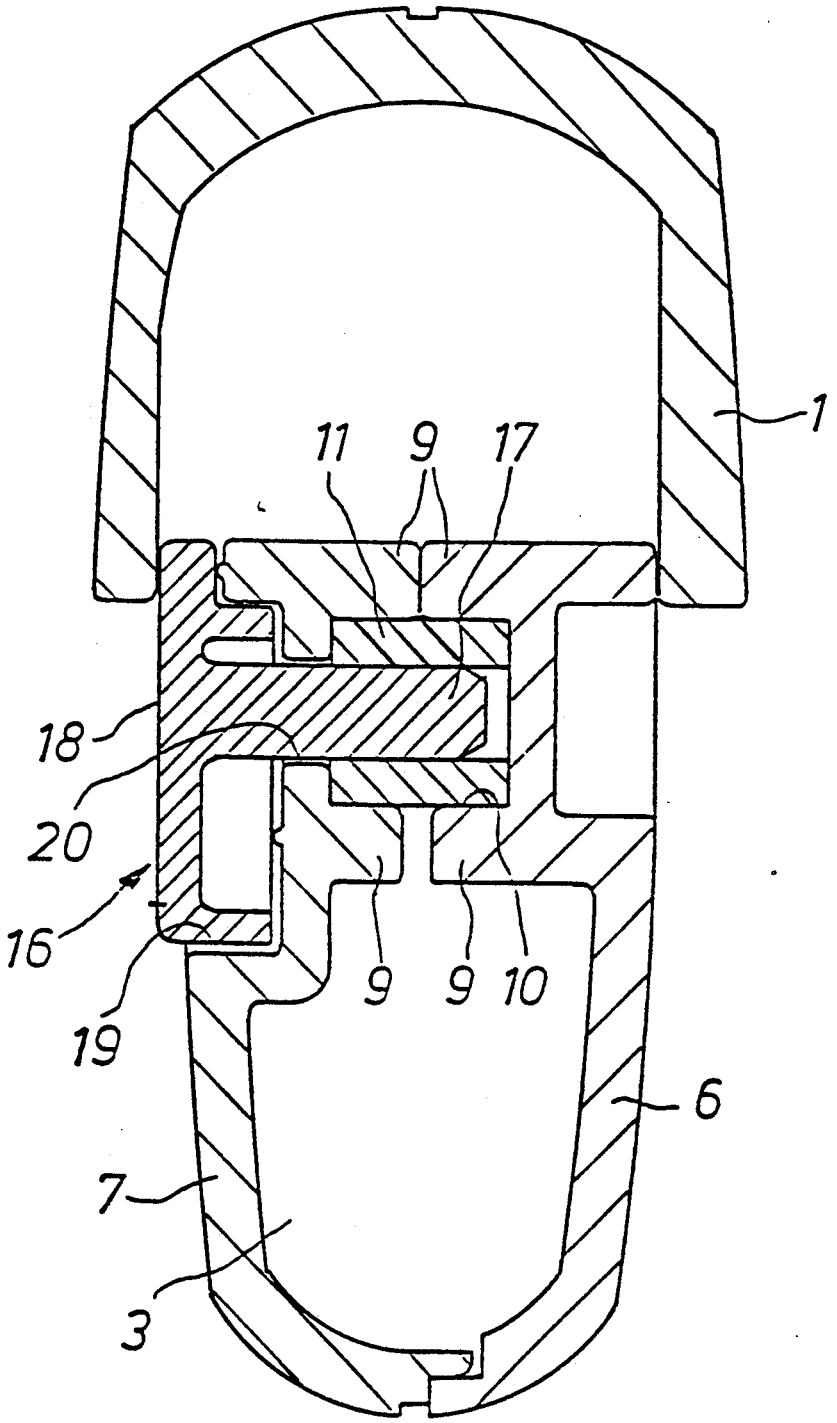
FIG. 3 is a sectional view taken along the line III—III of FIG. 2.

While the actuating handle 1 comprises a one-piece shell, the retaining handle (or grip) 3 is composed of a bottom part 6 and a top part 7 as more clearly shown in FIG. 2. The bottom and top parts 6 and 7 of retaining handle 3 are locked into place via mushroom-shaped buttons 8. By means of ribs 9 shown in FIG. 3, the top and bottom parts 6 and 7 form a guide conduit 10 for a drawbar 11. FIGS. 1–3 show that a clamping bracket 13 is secured to the front end 12 of the drawbar 11 with rivets 14. The clamping bracket 13 is embodied as a unitary die-cast part. A slide handle 16 is secured to the other end 15 of the drawbar 11. The slide handle comprises a retaining pin 17 and a thumb plate 18. The retaining handle top part 7 is provided with a guide groove 19 as shown in FIG. 2 for the thumb plate 18 and a guide slit 20 for the retaining pin 17.

FIGS. 1 and 2 show that a guide wall 22 and an opposed wall 23 are formed onto a front region 21 of the retaining handle 3 vertically of the guide conduit 10. The guide wall 22 and the opposed wall 23 are divided, to match the division of the retaining handle 3 into the bottom part 6 and top part 7.

A draw plate 24, loaded by a spring 25 and pierced by the drawbar 11, rests flat on the guide wall 22. The spring 25 is supported on the opposed wall 23. The draw plate 24 is extended on one side by an impingement region 26, which rests on a pressure rib 27 of the actuating handle 1. The pressure rib 27 and the guide wall 22 are located in the same plane, in the neutral position of the container lid opener shown in FIG. 1.

As best shown in FIG. 1, a front region 21 of the retaining handle 3 ends in its bottom part 6 in a receiving head 28 for the retaining jaws 29. The retaining jaws 29 comprise a sheet-metal part 30, the ends 31 of which are bent inward as illustrated in FIGS. 1 and 2.

The clamping bracket 13 is provided with three approximately circularly disposed clamping jaws 32 and 33, as counterparts to the retaining jaws 29. As shown in FIG. 1 which discloses the jaw set for small screw-on lids, the corners of the retaining jaws 29 and the tip of the middle clamping jaw 33, form an approximate equilateral triangle.

To prevent actuation of the actuating handle 1 from causing damage to the device when the drawbar 11 is pushed all the way in (small-jar position), a spacer protrusion 34 of FIG. 2 is provided on the clamping bracket 13; in the small-jar position shown, the spacer protrusion 34 just meets the draw plate 24. If the clamping bracket 13 is now thrust farther inward, then the draw plate 24 is pressed inward against the force of the spring 25, so that upon actuation of the actuating handle 1, the pressure rib 27 moves unimpeded by drawplate 24 into an open space.

If the actuating handle 1 is now swiveled in the direction of arrow 35 of FIG. 1, then first, via the pressure rib 27, the impingement region 26 of the draw plate 24 is inclined slightly to counter the force of the spring 25, until the play in the bore 36 is equalized. As soon as the play is equalized, the draw plate 24 clamps to the drawbar 11 and displaces drawbar 11 in the direction shown by arrow 37. A lid located between the clamping claws 32, 33 and the retaining claws 29 is then clamped onto firmly.

When used with larger screw-on jar lids, the slide handle 16 is displaced in the direction shown by arrow 38 until the lid can be placed easily between the clamping jaws 32, 33 and the retaining jaws 29. The process described above is then repeated. The location of the actuating handle 1 makes for logical easy operation and even a small force applied to the actuating handle 1 in the direction of arrow 35 is sufficient to swivel the actuating handle 1 in the direction shown by arrow 35 and thus in the clamping direction.

In order to hang up the tong-like device when not in use, the retaining handle 3 is provided with a suspension eyelet 39.

To prevent the drawbar from sliding out of the small-jar position by itself when the device is hung up, a retaining button 40 (in FIG. 2) is provided on the clamping bracket 13 which locks into place behind a sheathing region 41 of the actuating handle 1.

FIG. 1, in dot-dash lines, also shows a further position of the clamping bracket 13 for a larger screw-on jar lid.

While the invention has been described with reference to the drawings and structures disclosed herein, it is not confined to the details set forth, and is intended to cover modifications or changes as may come within the scope of the following claims.

What is claimed is:

1. A tong-like device for unscrewing screw-on lids of different sizes which are screwed onto containers, comprising:

a retaining handle having:

a front end;

jaw means mounted on said front end;

a front region;

an adjustable drawbar including:

a first end portion;

a longitudinal axis;

a clamping bracket having a substantially flat portion, the clamping bracket being attached to the first end portion of said adjustable drawbar;

said adjustable drawbar being capable of moving the clamping bracket toward and away from said jaw means along the longitudinal axis thereof;

an actuating handle pivotally mounted on said retaining handle, said actuating handle having a pressure rib formed thereon;

the retaining handle and the actuating handle each extending in a direction parallel to the longitudinal axis of the adjustable drawbar;

a guide wall on the front region of said retaining handle, said guide wall being positioned to be substantially perpendicular to said adjustable drawbar;

a drawplate mounted to be displaceable on the adjustable drawbar, said drawplate having an impingement zone defined thereon;

a compression spring mounted to urge the drawplate against the guide wall so that the impingement zone of the drawplate rests against the pressure rib of the actuating handle; and said pressure rib of the actuating handle being positioned in approximately the same plane as the guide wall above said front region of said retaining handle when the tong-like device is in a neutral position, whereby upon application of a squeezing force to the actuating handle toward the retaining handle when a screw-on lid is held by the clamping bracket and the jaw means, the drawplate, responsive to the application of the squeezing force, will initially displace the adjustable drawbar in a direction to cause said clamping bracket and said jaw means to tightly clamp onto said screw-on lid and thereafter to transmit said squeezing force to rotate said screw-on lid to thereby loosen said lid.

2. The tong-like device according to claim 1, wherein:

the retaining handle includes a bearing; and said actuating handle is mounted to pivot around said bearing.

3. The tong-like device according to claim 2, wherein the bearing has a bearing axis which when viewed in cross section is disposed in a given plane that is substantially perpendicular to the drawbar and adjacent to and parallel to the guide wall.

4. The tong-like device according to claim 1, wherein the retaining handle further comprises:

a slide handle secured to the drawbar for moving the drawbar along a path having a preset maximum length;

a guide slip for said slide handle.

5. The tong-like device according to claim 4, further comprising:

a spacer protrusion mounted on one of the clamping bracket and said adjustable drawbar;

said spacer protrusion resting on the drawplate when the tong-like device is in a small lid position, to prevent damage to the tong-like device if the clamping bracket is moved within a preset distance of the jaw means mounted on the retaining handle; and said spacer protrusion having a length which is substantially equal to the preset maximum length of the path along which the drawbar is movable by said slide handle.

6. The tong-like device according to claim 1, wherein:

the actuating handle has a U-shaped cross-section, the U-shaped cross-section having two substantially parallel vertical arms connected by a base section; and said U-shaped actuating handle accommodating the retaining handle between the vertical arms of the U when the actuating handle is squeezed toward the retaining handle.

7. The tong-like device according to claim 1, wherein the retaining handle includes two parts that are positioned to form a guide conduit for the drawbar.

8. The tong-like device according to claim 1, wherein:

the clamping bracket is riveted to the adjustable drawbar; and the clamping bracket comprises a unitary die cast part.

9. The tong-like device according to claim 1, wherein the clamping bracket includes said substantially flat portion at a central portion thereof.

10. The tong-like device according to claim 9, wherein:

the jaw means mounted on the front end of said retaining handle comprises two retaining claws;

the clamping bracket includes three approximately circularly disposed clamping claws including a middle claw mounted on an edge portion of said substantially flat portion of said clamping bracket; and the tong-like device, when in a small screw-on lie position, has the middle clamping claw of said clamping bracket and the two retaining claws disposed on the retaining handle forming approximately an equilateral triangle.

11. The tong-like device according to claim 10, wherein the two retaining claws mounted on the retaining handle comprise a unitary sheet metal part having first and second bent end portions;

said sheet metal part, when viewed in a small lid position of the tong-like device, having the first and second bent end portions thereof respectively extending at an angle in a direction toward the middle claw of the clamping bracket.

12. The tong-like device according to claim 1, wherein the drawbar has a polygonal torsion resisting cross section.

13. A tong-like device according to claim 4, wherein:

said slide handle is secured to the drawbar with the bracket attached thereto, for moving the drawbar in a first and a second direction, the second direction being opposite to the first directions, along the longitudinal axis of the drawbar and along a path having a preset maximum length, the preset maximum length of said path limiting a maximum movement of the drawbar with the bracket attached thereto, to a maximum predetermined position.

14. A device for loosening different sized screw-on lids from containers, said device comprising:

a retaining handle having:

a first end;

jaw means mounted on said first end;

an adjustable drawbar including:

a first end portion;

a longitudinal axis; and clamping means attached to the first end portion of said adjustable drawbar, said clamping means having a substantially flat portion;

said adjustable drawbar for moving the clamping means toward and away from said jaw means along said longitudinal axis thereof;

an actuating handle having an actuating portion, said actuating handle being pivotally mounted on said retaining handle;

the retaining handle and the actuating handle each extending in a respective direction parallel to the longitudinal axis of the adjustable drawbar;

displacement means mounted to displace said adjustable drawbar responsive to a movement of the actuating portion of the actuating handle toward the retaining handle, to move the clamping means toward said jaw means, whereby upon application of a force to the actuating handle to move the actuating handle toward the retaining handle when a screw-on lid is held by the clamping means and jaw means, the displacement means responsive to the application of the force initially displaces the adjustable drawbar in a direction to cause said clamping means and said jaw means to tightly clasp onto said screw-on lid and then to transmit said force to rotate said screw-on lid to thereby loosen said screw-on lid from a container on which said screw-on lid is mounted:

the actuating portion of the actuating handle including a pressure rib formed on said activating handle; and said displacement means comprises:

a guide wall attached to a front region of said retaining handle;

said guide wall being positioned to be substantially perpendicular to said adjustable drawbar;

a drawplate mounted to be displaceable on the adjustable drawbar, said drawplate having an impingement zone defined thereon;

said pressure rib of the actuating handle being positioned in approximately the same plane as the guide wall above said front region of said retaining handle when the tong-like device is in a neutral position; and a compression spring mounted to urge the drawplate against the guide wall so that the impingement zone of the drawplate rests against the pressure rib of the activating handle.

15. The device according to claim 14, wherein a screw-on lid of a bottle is held by the clamping means and the jaw means.

16. The device according to claim 14, wherein a screw-on lid of a jar is held by the clamping means and the jaw means.

17. A tong-like device according to claim 14, wherein the retaining handle further comprises:

a slide handle secured to the drawbar for moving the drawbar in a first and a second direction, the second direction being opposite to the first directions, along the longitudinal axis of the drawbar and along a path having a preset maximum length, the preset maximum length of said path limiting a maximum movement of the drawbar with the bracket attached thereto, to a maximum predetermined position; and a guide slip for said slide handle.

* * * * *